US011592018B2

(12) United States Patent
Xiao

(10) Patent No.: US 11,592,018 B2
(45) Date of Patent: Feb. 28, 2023

(54) SURFACE DRIVEN DOWNHOLE PUMP SYSTEM

(71) Applicant: SAUDI ARABIAN OIL COMPANY, Dhahran (SA)

(72) Inventor: Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 284 days.

(21) Appl. No.: 16/881,678

(22) Filed: May 22, 2020

(65) Prior Publication Data

US 2021/0363992 A1 Nov. 25, 2021

(51) Int. Cl.
*F04B 47/02* (2006.01)
*F04C 29/00* (2006.01)
(Continued)

(52) U.S. Cl.
CPC ..... *F04B 47/02* (2013.01); *F04B 17/03* (2013.01); *F04B 19/22* (2013.01); *F04B 53/144* (2013.01);
(Continued)

(58) Field of Classification Search
CPC ..... F04B 17/03; F04B 19/22; F04B 47/02; F04B 47/026; F04B 53/144; F04C 29/0064; E21B 43/126; E21B 43/127
(Continued)

(56) References Cited

U.S. PATENT DOCUMENTS 4,231,722 A * 11/1980 Teichmann ..... F04B 17/00 417/418
4,465,439 A * 8/1984 Seino ..... F04B 17/00 417/417
(Continued)

FOREIGN PATENT DOCUMENTS

CN 1079138 C 2/2002
CN 2858941 Y 1/2007
(Continued)

OTHER PUBLICATIONS

International Search Report and Written Opinion issued in corresponding International Application No. PCT/US2020/035178, dated Dec. 7, 2020 (12 pages).

*Primary Examiner* — Alexander B Comley
(74) *Attorney, Agent, or Firm* — Osha Bergman Watanabe & Burton LLP

(57) ABSTRACT

Systems to drive a downhole pump include an enclosure body with a magnetically transparent wall. A magnetic driver or a stationary member with coil windings in slots is disposed outside the enclosure body. A magnetic follower or a movable member with one or more permanent magnets is disposed inside the enclosure body such that the magnetic follower or movable member is exposed to a different environment compared to the magnetic driver or stationary member. The magnetic driver and magnetic follower, or the stationary member and movable member, are separated by a gap containing at least a portion of the magnetically trans-
(Continued)

parent wall. A prime mover is operatively coupled to the magnetic driver. A rod couples the magnetic follower or the movable member to the downhole pump. Movement of the rod with the magnetic follower or the movable member operates the pump.

10 Claims, 7 Drawing Sheets

(51) Int. Cl.
*F04B 17/03* (2006.01)
*F04B 19/22* (2006.01)
*F04B 53/14* (2006.01)

(52) U.S. Cl.
CPC ..... *F04C 29/0064* (2013.01); *F04C 29/0085* (2013.01)

(58) Field of Classification Search
USPC ..... 417/420, 555.2; 166/68, 68.5, 72, 105; 74/110
See application file for complete search history.

(56) References Cited

U.S. PATENT DOCUMENTS 5,104,299 A * 4/1992 Mizuno ..... F04B 17/00 417/418
5,363,912 A 11/1994 Wolcott
5,917,774 A * 6/1999 Walkow ..... G01V 11/005 181/102
6,289,986 B1 9/2001 Wright et al.
7,044,217 B2 5/2006 Hull
7,168,924 B2 * 1/2007 Beck ..... F04D 15/0066 417/1
8,587,163 B2 * 11/2013 Camacho ..... H02K 33/16 310/12.33
10,337,557 B1 * 7/2019 McMullen ..... H02K 7/09
10,400,761 B2 9/2019 Robison et al.
2004/0096344 A1 * 5/2004 Meucci ..... F04B 17/00 92/172
2005/0269889 A1 12/2005 Tessier et al.
2006/0043972 A1 * 3/2006 Williamson ..... G01V 3/18 324/323
2009/0260800 A1 10/2009 White et al.
2010/0243233 A1 9/2010 Salloum
2012/0224987 A1 * 9/2012 Jones ..... F04D 25/06 417/420
2016/0102534 A1 4/2016 Marshall et al.
2016/0222957 A1 * 8/2016 Robison ..... E21B 43/121
2017/0292353 A1 * 10/2017 Liu ..... E21B 47/009
2018/0171767 A1 * 6/2018 Huynh ..... F04D 13/10
2018/0334891 A1 11/2018 Markovitch et al.
2020/0191135 A1 * 6/2020 Huddleston ..... E21B 43/13

FOREIGN PATENT DOCUMENTS

CN 201202426 Y 3/2009
CN 105822249 A 8/2016
DE 3127893 A1 2/1983
DE 102012010146 A1 11/2013
GB 2105793 A * 3/1983 ..... F04B 15/04
NO 2017/201616 A1 11/2017
RU 2188932 C2 9/2002
RU 2499158 C1 11/2013
WO 2013/130128 A1 9/2013

* cited by examiner

SURFACE DRIVEN DOWNHOLE PUMP SYSTEM

BACKGROUND

Surface driven downhole pump systems that use reciprocating or rotating rods to transfer power from a surface above a well to a pump downhole in the well currently require stuffing boxes to prevent well fluids from leaking along or around the rods at the exit of the well. The stuffing boxes contain packing elements that dynamically seal around the rod. Regular inspection and maintenance, such as replacement of packing elements and grease injection, are required to ensure that the stuffing box keeps working properly. For applications with high wellhead pressure and high concentration of $H_2S$ in the well fluids, operators are reluctant to use surface driven downhole pumps out of concern for stuffing box leakage. For environmental protection and safety, it is desirable to achieve zero leakage of hydrocarbons in production operations.

SUMMARY

A surface driven downhole pump system includes an enclosure body having a magnetically transparent wall, a magnetic driver disposed outside the enclosure body, and a magnetic follower disposed within the enclosure body such that the magnetic follower is exposed to a different environment compared to the magnetic driver. The magnetic follower is magnetically coupled to follow movement of the magnetic driver through magnetic interaction across a gap between the magnetic follower and the magnetic driver. The gap contains at least a portion of the magnetically transparent wall. The system further includes a prime mover that is operatively coupled to the magnetic driver, a pump, and a rod having a first end coupled to the magnetic follower and a second end coupled to the pump. The rod moves with the magnetic follower and thereby operates the pump. The magnetic driver may include a plurality of first permanent magnets. The magnetic follower may include a plurality of second permanent magnets. In one case, the first and second permanent magnets may have an arrangement pattern to produce a linear movement of the magnetic follower from the movement of the magnetic driver. In this case, the pump may be a reciprocating pump. The magnetic driver and the magnetic follower may be in a coaxial arrangement. In another case, the first and second permanent magnets may have an arrangement pattern to produce a rotary movement of the magnetic follower. In this other case, the pump may be a progressive pump. The magnetic driver and the magnetic follower may have disc shapes and may be in a face-to-face arrangement. Alternatively, the magnetic driver and the magnetic follower may have tubular shapes and may be in a coaxial arrangement. The system may include a mechanism to transfer an output of the prime mover to the movement of the magnetic driver. The prime mover may be located at a surface. The pump may be located in a wellbore. The enclosure body may be disposed at a top of a wellhead assembly above the wellbore. The enclosure body may be fluidly connected to the wellbore through the wellhead assembly and structured to contain fluid pressure from the wellbore.

An apparatus to drive a pump includes an enclosure body having a magnetically transparent wall and a driver disposed outside the enclosure body. The driver includes one or more first permanent magnets. The apparatus further includes a follower disposed within the enclosure body such that the follower is exposed to a different environment compared to the driver. The follower includes one or more second permanent magnets. The follower is magnetically coupled to follow movement of the driver through magnetic interaction across a gap between the follower and the driver. The gap contains at least a portion of the magnetically transparent wall. The apparatus further includes a rod coupled to the follower and movable with the follower. The driver and the follower may have tubular shapes and may be in coaxial arrangement with each other and with the magnetically transparent wall. The driver and follower may have disc shapes, where an end face of the driver including the one or more permanent magnets is in opposing relation to an end face of the follower including the one or more second permanent magnets.

A surface driven downhole pump system includes an enclosure body having a magnetically transparent wall and an electric motor arranged in a surface region above a wellbore. The electric motor includes a stationary member having coil windings in slots. The electric motor includes a movable member having one or more permanent magnets. The stationary member is disposed outside the enclosure body. The movable member is disposed within the enclosure body such that the movable member is exposed to a different environment compared to the stationary member. The movable member and the stationary member are separated by a gap containing at least a portion of the magnetically transparent wall. The system includes a pump arranged downhole in the wellbore and a rod having a first end coupled to the movable member and a second end coupled to the pump. The rod moves with the movable member and thereby operates the pump. In one case, the electric motor may be a linear motor, and the movable member may be a linearly movable member. In this case, the pump may be a reciprocating pump. In another case, the electric motor may be a rotary motor, and the movable member may be a rotating member. In this other case, the pump may be a progressive cavity pump. The movable member, the stationary member, and the magnetically transparent wall may be in a coaxial arrangement. The enclosure body may be fluidly connected to the wellbore through a wellhead assembly and may be structured to contain fluid pressure from the wellbore. The pump may be disposed at an end of a tubing in the wellbore, and the rod may extend through the tubing to the pump. The enclosure body may be fluidly connected to the tubing.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
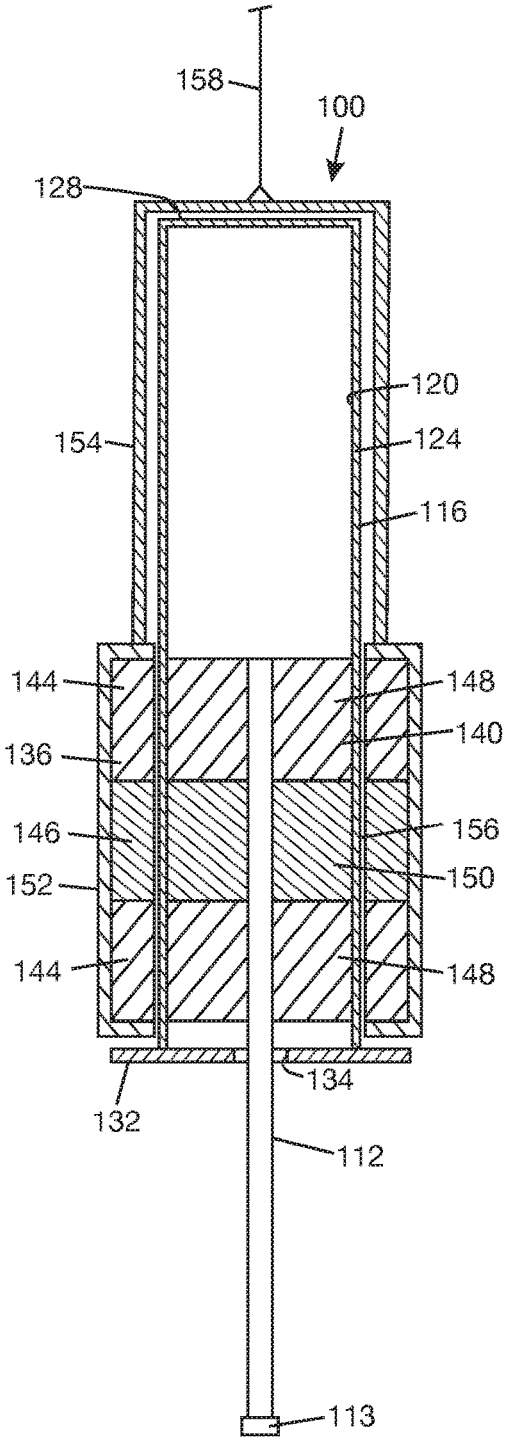
FIG. 1 is a cross-section of a linear magnetic coupling apparatus according to one illustrative implementation.

In this detailed description, certain specific details are set forth in order to provide a thorough understanding of various disclosed embodiments and implementations. However, one skilled in the relevant art will recognize that embodiments and implementations may be practiced without one or more of these specific details, or with other methods, components, materials, and so forth. In other instances, related well known features or processes have not been shown or described in detail to avoid unnecessarily obscuring the embodiments and implementations. For the sake of continuity, and in the interest of conciseness, same or similar reference characters may be used for same or similar objects in multiple figures.

FIG. 1 is an exemplary linear magnetic coupling apparatus 100 that may be used to couple power from a surface prime mover to a downhole pump. The downhole pump may be a reciprocating pump that is operated by reciprocating motion of a rod. Apparatus 100 includes an enclosure body 116 having an inner chamber 120. Enclosure body 116 has a side wall 124, which may be cylindrical or tubular in shape. Enclosure body 116 is closed at the top end by an end wall 128 that is connected to a top end of side wall 124. The bottom end of enclosure body 116 may include a connection feature, such as a plate (or flange) 132, to facilitate connection of enclosure body 116 to a wellhead assembly. The connection feature, e.g., plate 132, may be attached to or integrally formed with a bottom end of side wall 124. Plate 132 may have a central opening 134 that is connected to chamber 120. When enclosure body 116 is connected to a wellhead assembly, chamber 120 may be fluidly connected to a wellbore below the wellhead assembly through central opening 134 and passages in the wellhead assembly. In addition, when enclosure body 116 is connected to a wellhead assembly, enclosure body 116 with its closed end at end wall 128 isolates the internal system of the wellbore from the outside environment.

Apparatus 100 includes a magnetic coupling composed of two magnetic coupler halves, a driver 136 and a follower 140. Driver 136 is disposed outside enclosure body 116. Follower 140 is disposed within enclosure body 116, or inside chamber 120. Both driver 136 and follower 140 are movable relative to enclosure body 116. When enclosure body 116 is connected to a wellhead assembly, follower 140 will be in an environment that is connected to the wellbore, while driver 136 will be in an outside environment that is not connected to the wellbore. Each of driver 136 and follower 140 includes one or more permanent magnets. Example of permanent magnets include, but are not limited to, samarium cobalt magnets and neodymium magnets. In the illustrated example, driver 136 includes a stack of permanent magnets 144, which may be interleaved with spacers 146 made of, for example, ferromagnetic material such as soft iron. Also, in the illustrated example, follower 140 includes a stack of permanent magnets 148, which may be interleaved with spacers 150 made of, for example, ferromagnetic material such as soft iron. Each permanent magnet 144, 148 may have a cylindrical shape or may comprise curved permanent magnet segments arranged to form a cylindrical shape. The specific arrangements and numbers of permanent magnets used in driver 136 and follower 140 are design variables and can be adjusted based on the power coupling requirements. Permanent magnets 144 and optional spacers 146 may be attached to or otherwise carried by a sleeve 152, which may be arranged to surround side wall 124 of enclosure body 116. Permanent magnets 148 and optional spacers 150 may be disposed around and attached to an end portion of a rod 112. Rod 112 extends through central opening 134 in plate 132 and includes a connection end 113 for connection to other rods to make a rod string. The rod string may be used for operation of a downhole pump. Rod 112 may be made of a low magnetic material.

Figure 2:
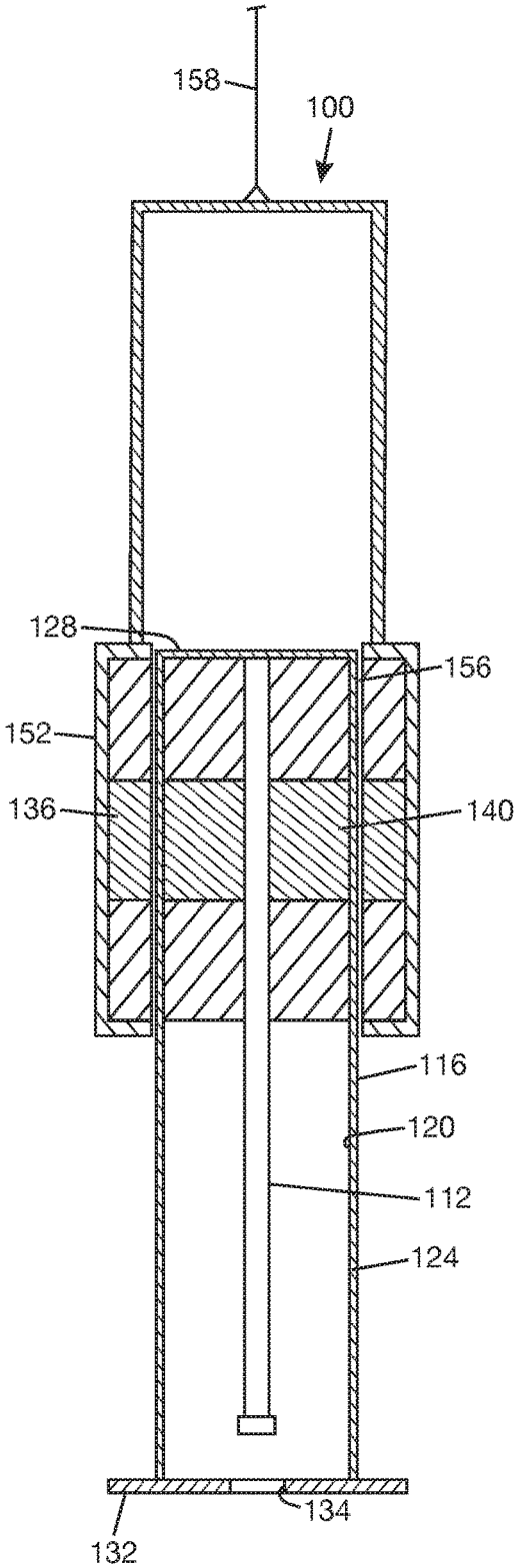
FIG. 2 is a cross-section of the linear magnetic coupling apparatus of FIG. 1 at a different stroke position from the one shown in FIG. 1.

In one implementation, driver 136 and follower 140 are cylindrical or tubular in shape and are coaxial with each other and with side wall 124 of enclosure body 116. Driver 136 and follower 140 are separated by a gap 156 and by side wall 124. A moving frame 154 may be attached to driver 136 (or to sleeve 152 that carries the permanent magnets of driver 136). Moving frame 154 may be coupled to a surface drive (not shown) via, for example, a cable 158 or other suitable linkage, such as a rod. The surface drive may be operated to raise or lower moving frame 154 relative to enclosure body 116, which would result in driver 136 moving up or down along side wall 124, or along an axial axis of enclosure body 116. Follower 140 is magnetically coupled to driver 136 through gap 156. As driver 136 moves up and down, follower 124 will follow the movement of driver 136 in an attempt to bring its magnetic field into equilibrium with the magnetic field of driver 136. The up and down motion (linear motion) of follower 140 will result in reciprocating motion of rod 112. FIG. 1 shows the beginning of an upstroke (or the end of a downstroke) of follower 140. FIG. 2 shows the end of an upstroke (or the beginning of a downstroke) of follower 140. Follower 140 can move between the two positions shown in FIGS. 1 and 2 to enable pumping of fluid by the downhole pump.

The magnetic fields of driver 136 and follower 140 interact across gap 156. As the width of gap 156 increases, linking of the magnetic fluxes of driver 136 and follower 140 across gap 156 will decrease, which would decrease the linear coupling force transferred from driver 136 to follower 140. To allow efficient transfer of linear coupling force from driver 136 to follower 140, the width of gap 156 should be as small as practical. Since side wall 124 is disposed in gap 156, the width of gap 156 is at least equal to the thickness of side wall 124 plus some clearance to avoid frictional contact between each of driver 136 and follower 140 and adjacent surfaces of side wall 124. In this case, the thickness of side wall 124 is a controlling factor in sizing of gap 156. The wall thickness of side wall 124 should be sufficient to allow enclosure body 116 to withstand or contain well pressure with a safety factor, i.e., when chamber 120 is fluidly connected to the wellbore. In addition to optimizing the width of gap 156, the material of side wall 124 is preferably magnetically transparent to avoid or minimize loss of magnetic field strength across gap 156. Magnetically transparent materials may be materials that are difficult to magnetize or non-magnetic materials. Examples of magnetically transparent materials include, but are not limited to, non-metallic materials such as thermoplastics and composites and non-magnetic metals or alloys such as Inconel, Monel, and some stainless steels.

Figure 3:
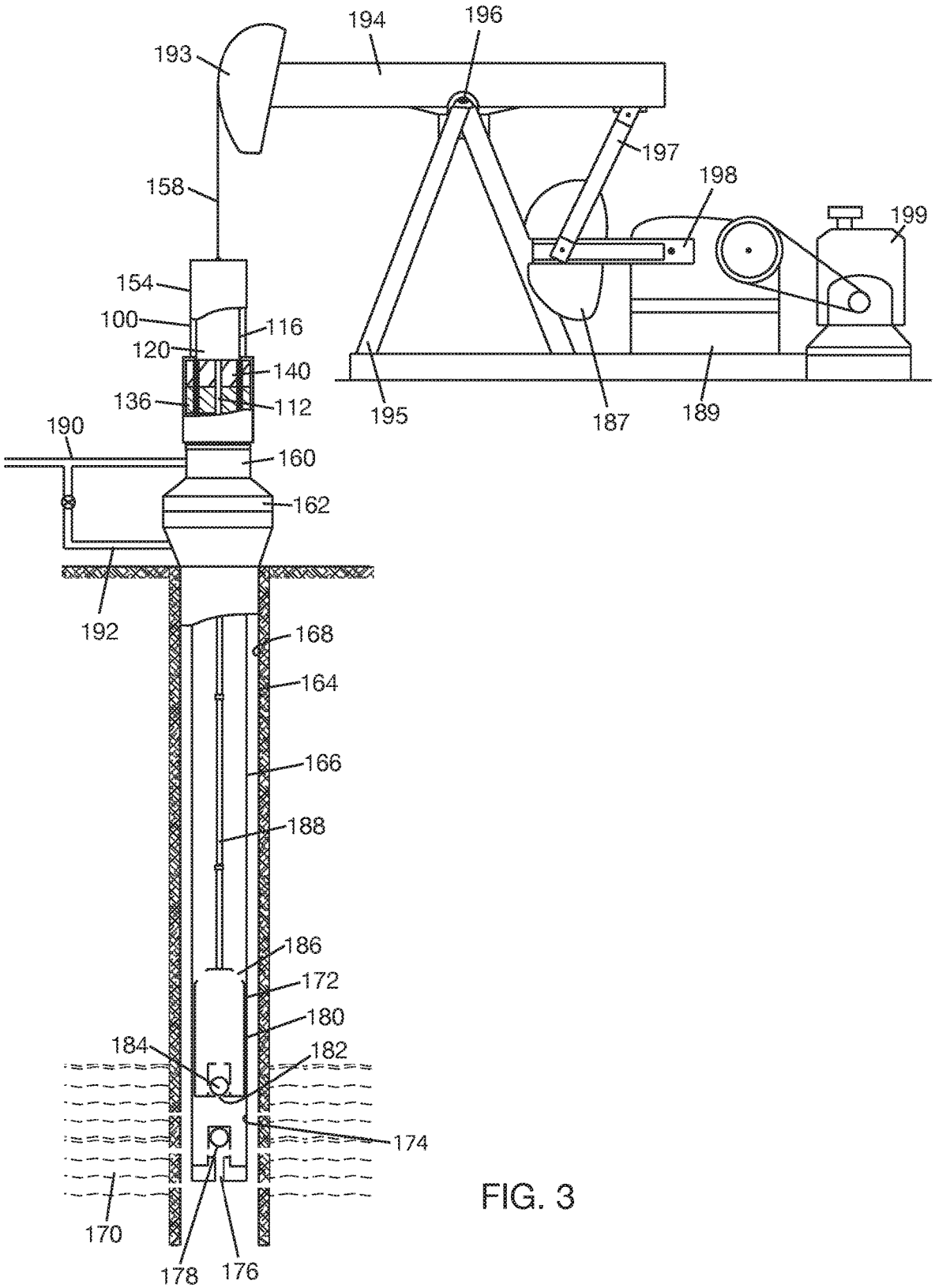
FIG. 3 is a schematic diagram of a pumping system incorporating the linear magnetic coupling apparatus of FIG. 1.

FIG. 3 shows an exemplary pumping system incorporating apparatus 100. For illustrative purposes, enclosure body 116 of apparatus 100 is mounted on top of a pumping tee 160 in a wellhead assembly. Pumping tee 160 is mounted on top of a wellhead 162 positioned at an opening of a wellbore 164. Chamber 120 inside enclosure body 116 is fluidly connected to wellbore 164 through passages in pumping tee 160 and wellhead 162. The top end of enclosure body 116 is closed so that fluid does not escape out of enclosure body 116. However, pumping tee 160 includes a side outlet through which fluids from wellbore can flow into a flowline 190. Another line 192 may be connected between flowline 190 and wellhead 162 (or between flowline 190 and wellbore 164) for venting of gas from wellbore 164. Wellhead 162 may include a hanger (not shown) to suspend a tubing 166 in wellbore 164. Tubing 166 is used to convey fluids from wellbore 164 to the surface. Wellbore 164 may be lined with a casing 168, which may be perforated to allow fluids from a producing zone 170 to enter into wellbore 164. A downhole pump 172 is disposed at the downhole end of tubing 166 to pump fluid from wellbore 164 to the surface. Downhole pump 172 may include a pump barrel 174, a port 176 at the bottom of the pump barrel 174 to allow fluid into pump barrel 174, a standing valve 178 to open and close port 176, and a plunger 180 disposed inside the pump barrel 174. Plunger 180 may include a port 182 to allow fluid to flow into plunger 180 and a traveling valve 184 to control flow through port 182. Fluid may flow out of plunger 180 into tubing 166 through ports 186. A rod string 188 is connected at one end to plunger 180 and at another end to rod 112 of apparatus 100. In this manner, rod string 188 is coupled to follower 140. In this case, rod 112 may be considered as an uppermost joint of rod string 188. Rod string 188 may extend through wellhead 162 and pumping tee 160 to connect to rod 112.

At the surface, moving frame 154 of apparatus 100 is coupled to a horsehead 193 by cable 158, often referred to as a bridle. Horse head 193 is attached to an end of a walking beam 194, which is mounted on a structural support 195, typically referred to as Samson post or Sampson post. The connection 196 between walking beam 194 and structural support 195 allows pivoting of walking beam 194 relative to structural support 195. Cable 158 follows the curve of horse head 193 as walking beam 194 pivots up and down to create a vertical or nearly-vertical stroke, which results in movement of driver 136 up and down along the side wall of enclosure body 116. Pitman arms 197 are pivotally connected to the other end of walking beam 194. To pitman arms 197 are attached cranks 198, which are connected to a power shaft (not visible) that is driven by a prime mover 199 and gearbox 189. Counterbalance weights 187 may be attached to cranks 189 to counterbalance the weight of driver 136. FIG. 3 shows downhole pump 172 at the beginning of an upstroke, where standing valve 178 is open and traveling valve 184 is closed. Upward motion of horse head 193 will result in upward motion of moving frame 154, which will result in upward motion of driver 136 of apparatus 100. Follower 140 will follow the motion of driver 136, moving rod string 188 and plunger 180 upward. For the pump downstroke, traveling valve 184 is open and standing valve 178 is closed, and plunger 180 moves downward.

Figure 4A:
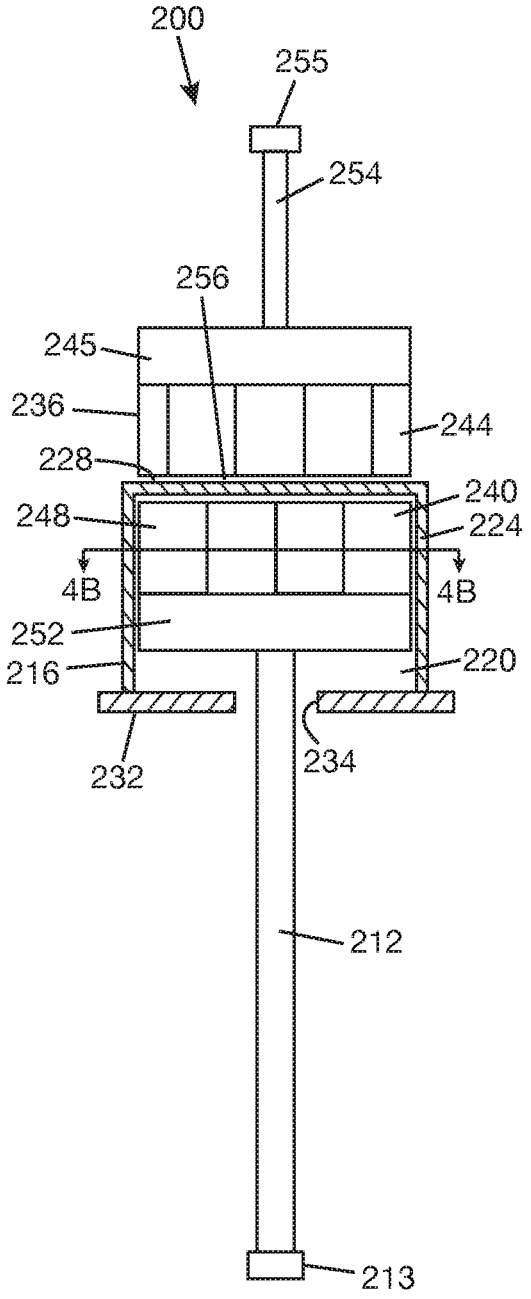
FIG. 4A is a partial cross-section of a rotary magnetic coupling apparatus according to one illustrative implementation.

FIG. 4A is an exemplary rotary magnetic coupling apparatus 200 that may be used to couple power from a surface prime mover to a downhole pump. The downhole pump may be a progressive cavity pump or other pump that is operated by a rotating rod. Apparatus 200 includes an enclosure body 216 having an inner chamber 220. Enclosure body 216 has a side wall 224, which may be cylindrical or tubular in shape. An end wall 228 is connected to a top end of side wall 224, closing enclosure body 216 at the top end. End wall 228 may be a planar wall. The bottom end of enclosure body 216 may include a connection feature, such as a plate 232, to facilitate connection of enclosure body 216 to a wellhead assembly. The connection feature, e.g., plate 232, may be attached to or integrally formed with a bottom end of side wall 224. Plate 232 may have a central opening 234 that is connected to chamber 220. When enclosure body 216 is connected to a wellhead assembly, chamber 220 may be fluidly connected to a wellbore below the wellhead assembly through central opening 234 and passages in the wellhead assembly. Also, when enclosure body 216 is connected to a wellhead assembly, enclosure body 216 with its closed end at end wall 228 isolates the internal system of the wellbore from the outside environment.

Figure 4B:
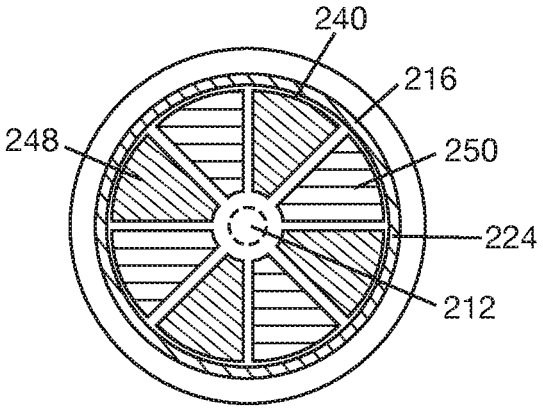
FIG. 4B is a cross-section of FIG. 4A along line 4B-4B.

Apparatus 200 includes a magnetic coupling composed of two magnetic coupler halves, a driver 236 and a follower 240. Driver 236 is disposed outside enclosure body 216 and adjacent to an outer surface of end wall 228. Follower 240 is disposed within enclosure body 216, or inside chamber 220, and adjacent to an inner surface of end wall 228. Driver 236 includes one or more permanent magnets 244 arranged to form a disc. Permanent magnets 244 may be arranged alternately with spacers made of ferromagnetic material such as soft iron. Permanent magnets 244 (and spacers if used) may be attached to a disc-shaped backing plate 245. Follower 240 includes one or more permanent magnets 248 arranged to form a disc. Permanent magnets 248 may be arranged alternately with spacers made of ferromagnetic material such as soft iron. An example of arrangement of permanent magnets 248 is shown in FIG. 4B. FIG. 4B also shows that permanent magnets 248 may be arranged alternately with spacers 250, which may be made of a ferromagnetic material, such as soft iron. The arrangement of the permanent magnets (and alternating spacers if used) for driver 236 may be similar to what is shown in FIG. 4B, including alternating arrangement of the magnets with spacers. The magnet arrangement shown in FIG. 4B will produce axial magnetic flux. Returning to FIG. 4A, permanent magnets 248 (and spacers if used) may be attached to a disc-shaped backing plate 252. Backing plates 245, 252 may be made of, for example, steel or other ferromagnetic material, such as iron. The specific numbers, shapes, and sizes of permanent magnets used in driver 236 and follower 240 are design variables and can be adjusted based on the power coupling requirements. Driver 236 and follower 240 are on opposite sides of end wall 228. Driver 236 and follower 240 are in face-to-face relationship, i.e., a planar end face of driver 236 formed by permanent magnets 244 and a planar end face of follower 240 formed by permanent magnets 248 are in opposing relation. Driver 236 and follower 240 are separated by a gap 256, which contains at least a portion of end wall 228.

A shaft 254 may be connected to driver 236, e.g., connected to backing plate 245. Shaft 254 may have a connection end 255 for connecting to an output shaft of a surface drive (not shown). A rod 212 may be connected to follower 240, e.g., connected to backing plate 252. Rod 212 extends through central opening 234 in plate 232 and includes a connection end 213 for connecting to other rods to make a rod string. As shaft 254 rotates, driver 236 will be rotated. Follower 240 is magnetically coupled to driver 236 through gap 256. As driver 236 is rotated, follower 240 will follow rotation of driver 236, resulting in rotation of rod 212. The magnetic fields of driver 236 and follower 240 interact across gap 256. To allow efficient transfer of torque from driver 236 to follower 240, gap 256 should be as small as practical while allowing end wall 228 to have a sufficient wall thickness to enable enclosure body 216 to contain well pressure with a safety factor, i.e., when chamber 220 is fluidly connected to the wellbore. In addition, the material of end wall 228 is preferably made of a magnetically transparent material as previously described relative to side wall 124 (in FIG. 1). The amount of torque coupling from driver 236 to follower 240 is also affected by the outer diameters of the discs formed by the magnets of driver 236 and follower 240. In general, torque coupling increases with increasing outer diameters of driver 236 and follower 240. However, rotational speed will tend to decrease with larger outer diameters, and this should be taken into consideration while sizing driver 236 and follower 240.

Figure 4C:
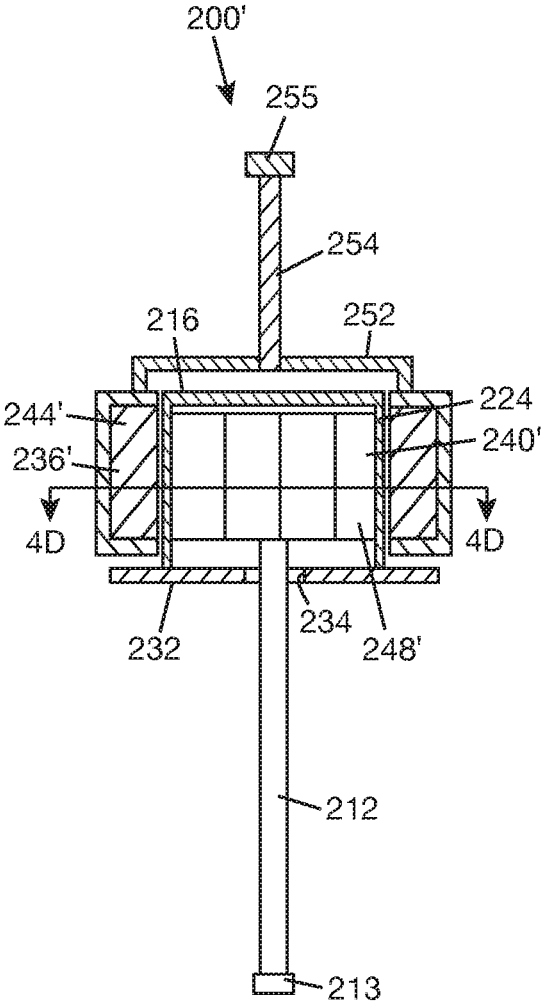
FIG. 4C is a cross-section of a rotary magnetic coupling apparatus according to another illustrative implementation.
Figure 4D:
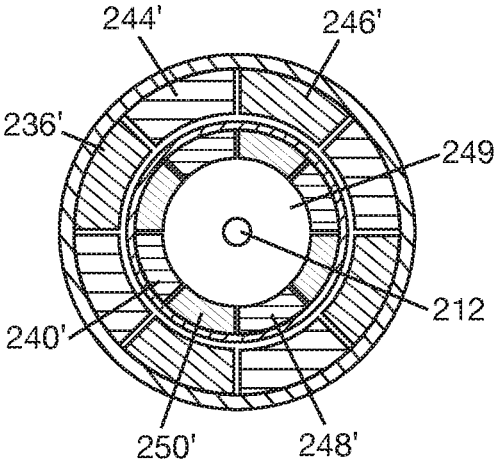
FIG. 4D is a cross-section of FIG. 4C along line 4D-4D.

FIG. 4C is a variation 200' of the rotary magnetic coupling apparatus of FIG. 4A. In FIG. 4C, driver 236' is disposed outside enclosure body 216 and surrounds side wall 224 as generally described for the driver shown in FIGS. 1 and 2. Driver 236' includes one or more permanent magnets 244', which may be interleaved with spacers 246', as shown in FIG. 4D. Follower 240' is disposed inside enclosure body 216. Follower 240' includes one or more permanent magnets 248', which may be interleaved with spacers 250', as shown in FIG. 4D. Permanent magnets 248' may be arranged around and coupled, e.g., attached to, a tubular core 249, which may be made of a ferromagnetic material such as iron. Spacers 246', 250' may be made of a ferromagnetic material such as iron. The magnet arrangement shown in FIG. 4D will produce a radial magnetic flux. Driver 236', follower 240', and side wall 224 may have tubular shapes and may be coaxial as described for the driver, follower, and side wall shown in FIG. 1. However, driver 236' and follower 240' will produce rotary motion due to the arrangement of the magnets. Shaft 254 with connection end 255 may be coupled to driver 236', e.g., via a frame 252. Rotation of shaft 254 will result in rotation of driver 236', which would result in rotation of follower 240'. Rod 212 with connection end 213 may be coupled to core 249 and will thereby rotate with follower 240'.

Figure 5:
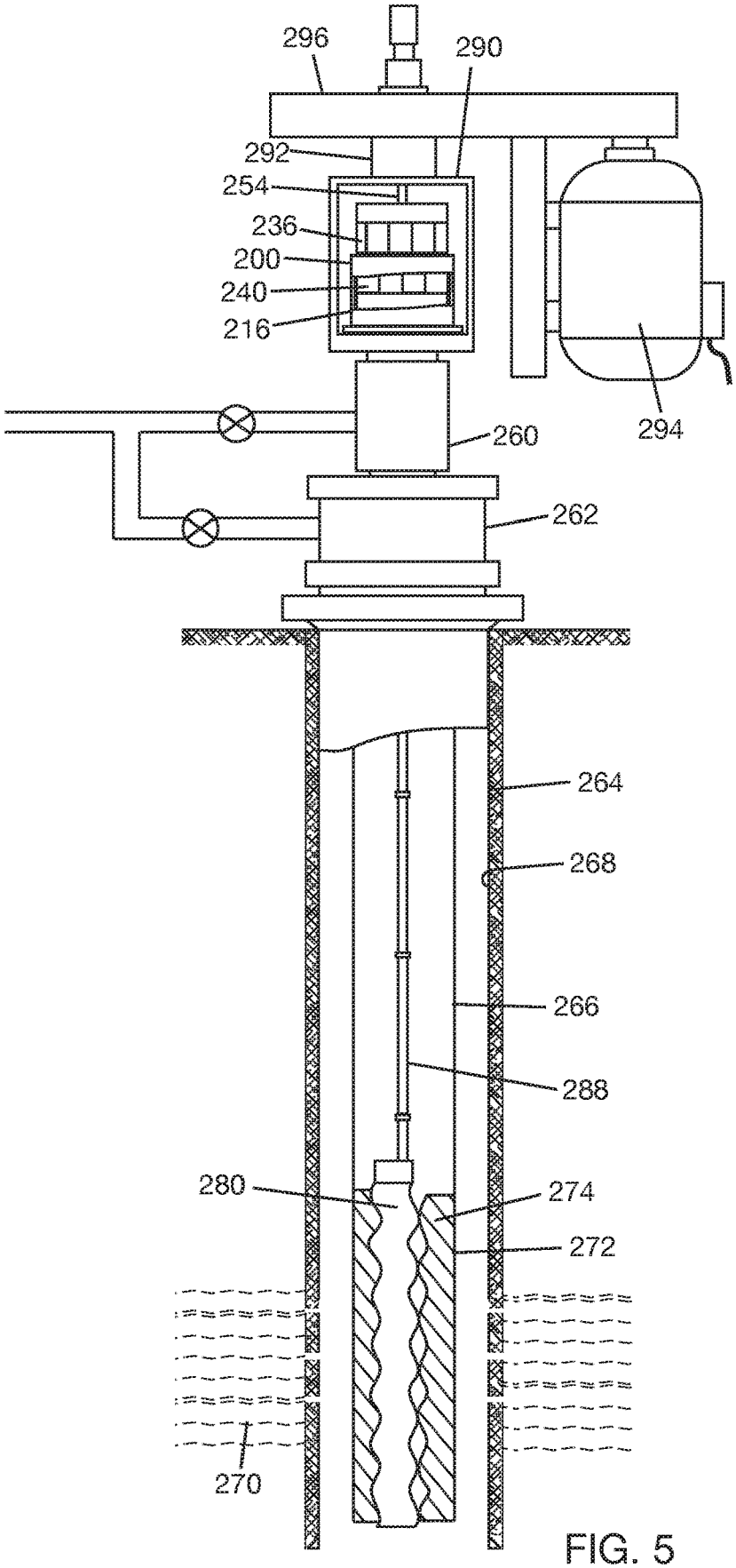
FIG. 5 is a schematic diagram of a pumping system incorporating the rotary magnetic coupling apparatus of FIG. 4A.

FIG. 5 shows an exemplary pumping system incorporating apparatus 200. For illustrative purposes, enclosure body 216 may be mounted in a frame 290 of a wellhead drive 292, and shaft 254 of apparatus 200 may be coupled to an output shaft of wellhead drive 292. Power from a prime mover 294, e.g., an electric motor, is transferred to wellhead drive 292 through a transmission system 296 that may include, for example, belts and sheaves. Frame 290 may be mounted on a pumping tee 260, which may be mounted on top of a wellhead 262 positioned at an opening of a wellbore 264. The chamber inside enclosure body 216 (220 in FIG. 4) is fluidly connected to wellbore 264 through passages in frame 290, pumping tee 260, and wellhead 262. The upper end of enclosure body 216 is closed so that fluid does not escape out of enclosure body 216. Wellhead 262 may include a hanger to hang a tubing 266 in wellbore 264. Wellbore 264 may be lined with casing 268, which may be perforated to allow fluid from a producing zone 270 to enter into wellbore 264. A downhole pump 272 may be disposed at the downhole end of tubing 266. Downhole pump 272 may be a progressive cavity pump including a helical rotor 280 nested inside a stator 274. Typically, the stator includes a piece of pipe with an elastomer bonded inside. The elastomer has a helix that matches that of the rotor. Rotor 280 is connected to a rod string 288, which is connected to rod 212 (in FIG. 4A) that is coupled to follower 240. Driver 236 is coupled to wellhead drive 292 through shaft 254. As a result, driver 236 can be rotated by wellhead drive 292. As driver 236 rotates, follower 240 will follow the motion of driver 236, resulting in rotation of rod string 288 and rotor 280. As rotor 280 rotates, pockets of fluids are trapped between rotor 280 and stator 274 and transported upwards over the length of the pump. Apparatus 200' in FIGS. 4C and 4D can be incorporated into a pumping system in the same manner described for apparatus 200 with reference to FIG. 5.

Figure 6:
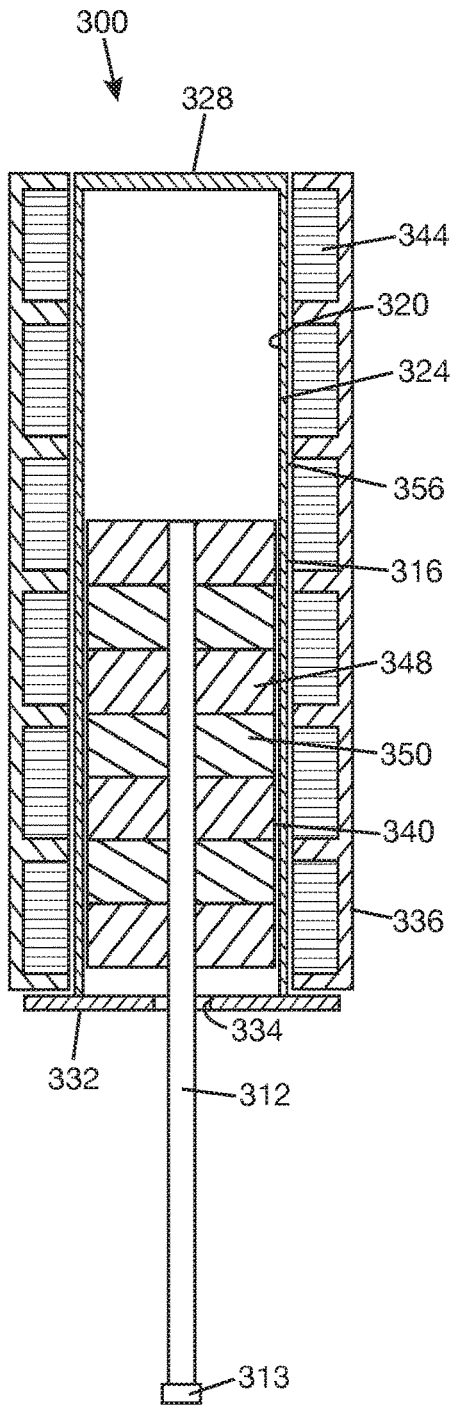
FIG. 6 is a cross-section of a linear motor apparatus according to one illustrative implementation.

FIG. 6 shows a linear motor apparatus 300 that may be used to drive a downhole pump according to one illustrative implementation. The linear motor apparatus operates with the moving motor part contained entirely within an enclosure that can be fluidly connected to a wellbore, eliminating the need for a stuffing box to control leakage of wellbore fluids. Apparatus 300 includes an enclosure body 316 having an inner chamber 320. Enclosure body 316 has a side wall 324 and an end wall 328 that closes the enclosure body at the top end. A plate 332 may be attached to the bottom end of side wall 324 for connection of enclosure body 316 to a wellhead assembly. Plate 332 may include a central opening 334 that is connected to chamber 320. Apparatus 300 includes a linear motor composed of a linear motor stator 336 and a motor slider 340. Motor slider 340 is disposed within enclosure body 316, or inside chamber 320. Motor stator 336 is disposed outside enclosure body 316. Motor stator 336 is separated from motor slider 340 by a gap 356, which contains at least a portion of side wall 324 of enclosure body 316. Side wall 324 may be made of a magnetically transparent material, as described for side wall 124 in FIG. 1.

Motor slider 340 includes one or more permanent magnets 348, which may be interleaved with spacers 350 made of a ferromagnetic material such as iron. Motor stator 336 includes coil windings 344 in slots. In operation, coil windings 344 can be connected to a power supply (not shown) to produce a magnetic field. By changing the current phase in the coils, the polarity of each coil is changed. The attractive and repelling forces between the coils in stator 336 and the permanent magnets in slider 340 cause slider 340 to move and generate a linear force. The rate of change of the supplied current controls the velocity of the movement, and the amperage of the current determines the force generated. Transformers and variable speed drive/controller can be used to control and operate the motor to achieve linear reciprocating motion of slider 340. A rod 312 is attached to motor slider 340 so that the reciprocating motion of slider 340 results in reciprocating motion of the rod. Rod 312 extends through central opening 334 in plate 332 and may include a connection end 313 for connection to other rods or to make a rod string. The rod string can be used for operation of a downhole pump.

Figure 7:
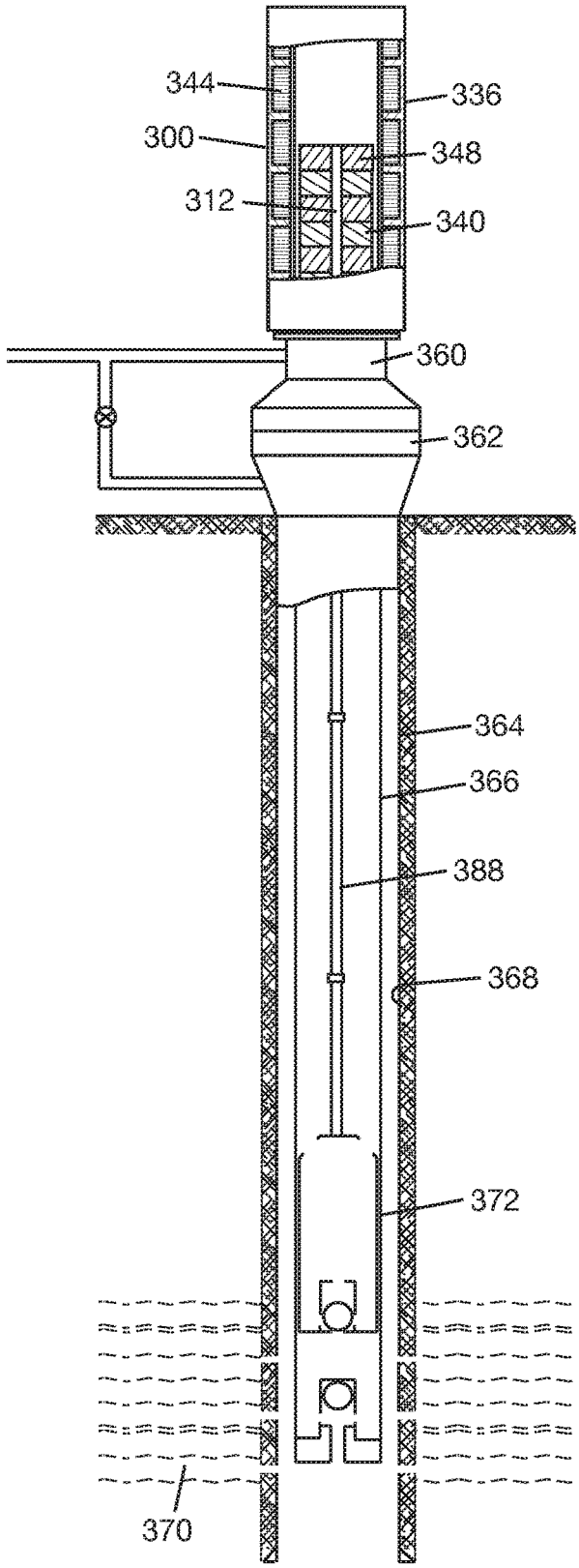
FIG. 7 is a schematic diagram of a pumping system incorporating the linear motor apparatus of FIG. 6.

FIG. 7 shows apparatus 300 mounted on a pumping tee 360, which is mounted on a wellhead 362. Rod 312 of apparatus 300 has been connected to a rod string 388 that is connected to a downhole pump 372 in a wellbore 364. Downhole pump 372 can be installed at an end of a tubing 366 hung in wellbore 364 from wellhead 362. Tubing 366 serves as a fluid conduit from the bottom of wellbore 364 to the surface. Wellbore 364 may be lined by a casing 368, which may be perforated to allow fluids from a producing zone 370 to enter into wellbore 364. To lift fluids from wellbore 364 to the surface, controlled current can be supplied to the coil windings of motor stator 336 to achieve reciprocating motion of slider 340 and connected rod string 388. In general, pump 372 will operate as described for pump 172 (in FIG. 3). Since slider 340 is disposed inside enclosure body 316, slider 340 is in a higher pressure and different fluid environment compared to stator 336. In particular, slider 340 is exposed to fluid pressure in wellbore 364, whereas stator 336 is not exposed to fluid pressure in wellbore 364. Enclosure body 316 has wall thicknesses selected to contain fluid pressure from wellbore 364 with a safety factor.

Figure 8:
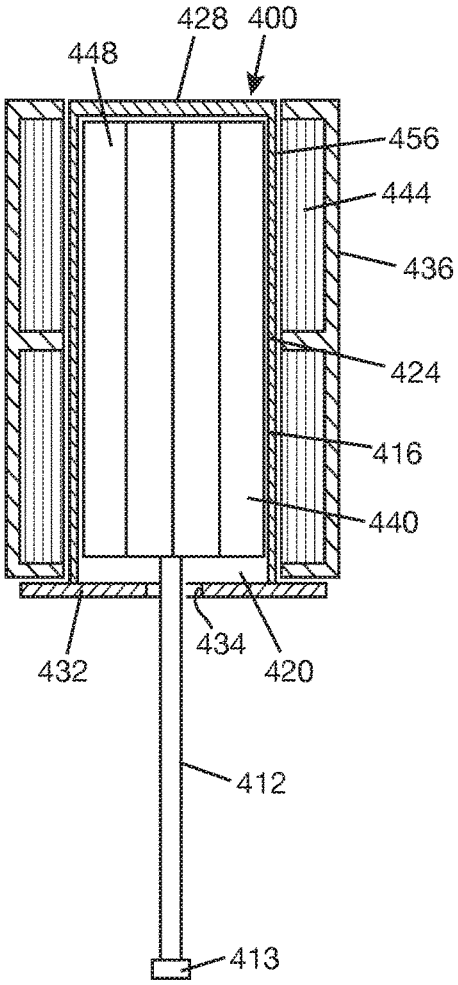
FIG. 8 is a cross-section of a rotary motor apparatus according to another illustrative implementation.

FIG. 8 shows another apparatus 400 that may be used to drive a downhole pump. Apparatus 400 is a rotary motor that is operated by a power supply. The rotary motor operates with the rotor contained entirely within an enclosure that can be fluidly connected to a wellbore, eliminating the need for a stuffing box to control leakage of wellbore fluids. Apparatus 400 includes an enclosure body 416 having an inner chamber 420. Enclosure body 416 has a side wall 424 and an end wall 428 that closes the enclosure body at the top end. A plate 432 may be attached to the bottom end of side wall 424 for connection of enclosure body 416 to a wellhead assembly. Plate 432 may include a central opening 434 that is connected to chamber 420. Apparatus 400 includes a rotary motor composed of a stator 436 and a rotor 440. Rotor 440 is disposed within enclosure body 416, or inside chamber 420. Stator 436 is disposed outside enclosure body 416. Stator 436 is separated from rotor 440 by a gap 456, which contains at least a portion of side wall 424 of enclosure body 416. Side wall 424 may be made magnetically transparent material, as described for side wall 124 in FIG. 1. Rotor 440 includes one or more permanent magnet 448. Stator 436 has coil windings 444 in slots. Coil windings 444 can be connected to a power supply (not shown) to produce a magnetic field. The attractive and repelling forces between the coils in stator 436 and the permanent magnets in rotor 440 will cause rotor 440 to move and generate a torque. The torque can be transferred to a rod 412 that is coupled to rotor 440. Rod 412 includes a connection end 413 for connection to other rods or to make a rod string. The rod string can be used to operate a downhole pump.

Figure 9:
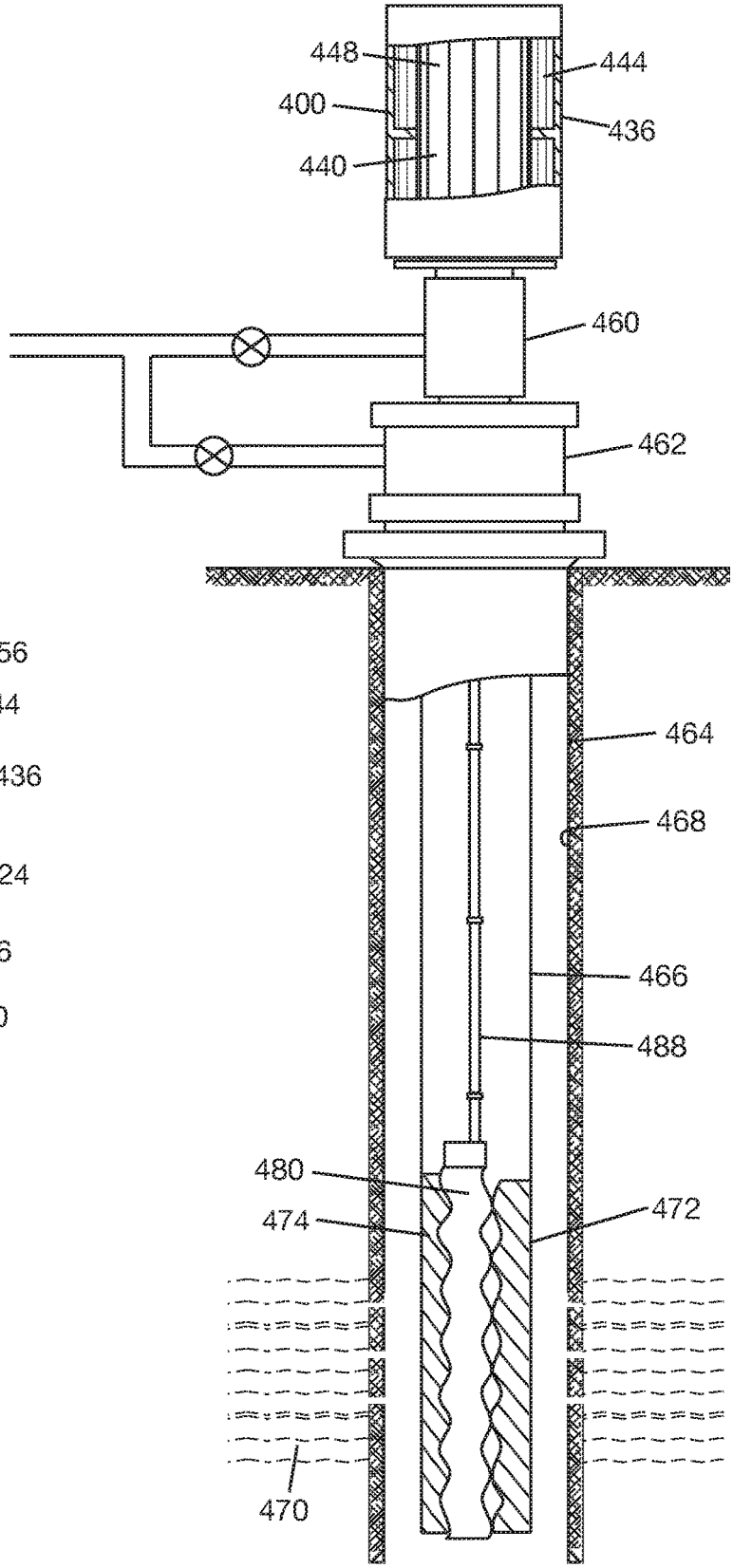
FIG. 9 is a schematic diagram of a pumping system incorporating the rotary motor apparatus of FIG. 8.

FIG. 9 shows apparatus 400 mounted on a pumping tee 460, which is mounted on a wellhead 462. Rod 412 of apparatus 400 has been connected to a rod string 488 that is connected to a downhole pump 472 in a wellbore 464. Downhole pump 472 can be installed at an end of a tubing 466 hung in wellbore 464 from wellhead 462. Tubing 466 serves as a fluid conduit from the bottom of wellbore 464 to the surface. Wellbore 464 may be lined by a casing 468, which may be perforated to allow fluids from a producing zone 470 to enter into wellbore 464. To lift fluids from of wellbore 464 to the surface, current can be supplied to the coil windings of motor stator 436 to move rotor 440 and generate torque. The torque will be transferred to rod string 488, which will rotate rotor 480 of pump 472. As rotor 480 rotates within stator 474, fluid will be transported along the length of the pump. In general, pump 472 will operate as described for pump 272 (in FIG. 5). Since rotor 440 is disposed inside enclosure body 416, rotor 440 is in a higher pressure and different fluid environment compared to stator 436. In particular, rotor 440 is exposed to fluid pressure in wellbore 464, whereas stator 436 is not exposed to fluid pressure in wellbore 464. Enclosure body 416 has wall thicknesses selected to contain fluid pressure from wellbore 464 with a safety factor.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art. The teachings provided herein can be applied to other types of pumping systems, not necessarily the exemplary pumping systems generally described above.

What is claimed is:

1. A system comprising:

an enclosure body having a magnetically transparent wall;

a magnetic driver disposed outside the enclosure body;

a magnetic follower disposed within the enclosure body such that the magnetic follower is exposed to a different environment than the magnetic driver, the magnetic follower being magnetically coupled to follow movement of the magnetic driver through magnetic interaction across a gap between the magnetic follower and the magnetic driver, the gap containing at least a portion of the magnetically transparent wall;

a prime mover operatively coupled to the magnetic driver;

a pump; and a rod having a first end coupled to the magnetic follower and a second end coupled to the pump, the rod to move with the magnetic follower and thereby operate the pump;

wherein the prime mover is located at a surface, wherein the pump is located in a wellbore, wherein the enclosure body is disposed at a top of a wellhead assembly above the wellbore, and wherein the enclosure body is fluidly connected to the wellbore through the wellhead assembly and structured to contain fluid pressure from the wellbore.

2. The system of claim 1, wherein the magnetic driver comprises a plurality of first permanent magnets, and wherein the magnetic follower comprises a plurality of second permanent magnets.

3. The system of claim 2, wherein the first and second permanent magnets have an arrangement pattern to produce a linear movement of the magnetic follower from the movement of the magnetic driver.

4. The system of claim 3, wherein the pump is a reciprocating pump.

5. The system of claim 3, wherein the magnetic driver and the magnetic follower are in a coaxial arrangement.

6. The system of claim 2, wherein the first and second permanent magnets have an arrangement pattern to produce a rotary movement of the magnetic follower.

7. The system of claim 6, wherein the pump is a progressive cavity pump.

8. The system of claim 6, wherein the magnetic driver and the magnetic follower have disc shapes and are in a face-to-face arrangement.

9. The system of claim 6, wherein the magnetic driver and the magnetic follower have tubular shapes and are in a coaxial arrangement.

10. The system of claim 1, further comprising a mechanism positioned to transfer an output of the prime mover to the movement of the magnetic driver.

* * * * *